United States Patent [19]

Saad

[11] Patent Number: 4,491,810

[45] Date of Patent: Jan. 1, 1985

[54] MULTI-PORT, MULTI-FREQUENCY MICROWAVE COMBINER WITH OVERMODED SQUARE WAVEGUIDE SECTION

[75] Inventor: Saad M. Saad, Chicago, Ill.

[73] Assignee: Andrew Corporation, Orland Pk., Ill.

[21] Appl. No.: 461,930

[22] Filed: Jan. 28, 1983

[51] Int. Cl.[3] ..... H01P 1/213

[52] U.S. Cl. ..... 333/126; 333/135; 333/21 A

[58] Field of Search ..... 333/134–137, 333/124–126, 129, 21 A, 21 R, 210–212, 253; 343/756, 786

[56] References Cited

U.S. PATENT DOCUMENTS

| | | | |
|---|---|---|---|
| 2,651,759 | 8/1953 | Lomont et al. | 333/137 |
| 2,908,872 | 10/1959 | Garoff . | |
| 4,047,128 | 9/1977 | Morz | 333/21 AX |
| 4,077,039 | 2/1978 | Ren et al. . | |
| 4,258,366 | 3/1981 | Green . | |
| 4,410,866 | 10/1983 | Bui-Hai | 333/135 |

FOREIGN PATENT DOCUMENTS

| | | | |
|---|---|---|---|
| 2709565 | 6/1978 | Fed. Rep. of Germany | 333/137 |
| 28676 | 2/1980 | Japan | 333/137 |

OTHER PUBLICATIONS

Article entitled "Frequency Reuse Feed for Domsat Ground Stations" by G. W. Collins.

Brochure entitled "*Test Protocol* for Linearly Polarized OMT with Mechanical Polarized Adjustment".

*Primary Examiner*—Paul Gensler

*Assistant Examiner*—Benny Lee

*Attorney, Agent, or Firm*—Leydig, Voit, Osann, Mayer & Holt, Ltd.

[57] ABSTRACT

A multi-port, multi-frequency combiner comprising a main waveguide having a cross-section in the shape of a right-angle parallelogram and dimensioned to simultaneously propagate co-polarized signals in different frequency bands and at least one signal that is orthogonally polarized with respect to the co-polarized signals, at least a portion of the waveguide being overmoded; a plurality of junctions spaced along the length of the main waveguide for coupling selected signals in the different frequency bands in and out of the waveguide, at least one of the junctions being located in an overmoded portion of the waveguide, each of the junctions having an unbalanced or pseudo-balanced feed with only a single side-arm waveguide for transmitting and receiving the signals; and filtering means disposed within the main waveguide and operatively associated with each junction therein for signals in the highest frequency band, the filtering means having (1) a stopband characteristic for coupling signals in the highest frequency band between the main waveguide and the junction and the side-arm waveguide connected thereto, and (2) a passband characteristic for passing signals in lower frequency bands past the junction. In the preferred embodiment of the invention, the waveguide has an overmoded section with a square cross-section and a single-moded section with a rectangular cross-section, with the overmoded and singlemoded sections being joined by a transition section having at least one side wall which is tapered to effect the transition from the square cross-section to the rectangular cross-section.

22 Claims, 8 Drawing Figures

MULTI-PORT, MULTI-FREQUENCY MICROWAVE COMBINER WITH OVERMODED SQUARE WAVEGUIDE SECTION

TECHNICAL FIELD

The present invention relates generally to microwave systems, and, more particularly, to microwave combining networks commonly referred to as "combiners". Combiners are devices that are capable of simultaneously transmitting and/or receiving two or more different microwave signals. The present invention is particularly concerned with combiners which can handle co-polarized signals in two or more frequency bands and, if desired, in combination with one or more orthogonally polarized signals; the orthogonally polarized signals can also be handled in two or more frequency bands.

BACKGROUND ART

In the propagation of microwave signals, it is generally desired to confine the signals to one propagation mode in order to avoid the distortions that are inherent in multimode propagation. The desired propagation mode is usually the dominant mode, such as the $TE_{10}$ mode in a square waveguide. The higher order modes can be suppressed by careful dimensioning of the waveguide such that the higher order modes are cut off. In certain instances, however, it is necessary for portions of the waveguide to be large enough to support more than one frequency band, and a discontinuity in such a waveguide can give rise to undesired higher order modes. For this reason, such waveguide sections are often referred to as "multi-mode" or "overmoded" waveguide.

One example of a waveguide system that requires an overmoded waveguide section is a system that includes a multi-port, multi-frequency combiner. For example, four-port combiners are typically used to permit a single antenna to launch and/or receive microwave signals in two different frequency bands in each of two orthogonal polarizations. Each of these frequency bands is usually at least 500 MHz wide. For instance, present telecommunication microwave systems generally transmit signals in frequency bands which are referred to as the "4 GHz", "6 GHz" and "11 GHz" bands, but the actual frequency bands are 3.7 to 4.2 GHz, 5.925 to 6.425 GHz, and 10.7 to 11.7 GHz, respectively. Signals of a given polarization in any of these bands must be propagated through the combiner without perturbing signals in any other band, without perturbing orthogonally polarized signals in the same band, and without generating unacceptable levels of unwanted higher order modes of any of the signals.

Elaborate and/or costly precautions have previously been taken to avoid the discontinuities that could give rise to undesired higher order modes in multi-frequency combiners of the type described above. For example, U.S. Pat. No. 4,077,039 discloses such a combiner that uses a pseudo-balanced feed in the tapered portion of a flared horn, in combination with evanescent mode waveguide filters in the side arms of the high frequency port of the combiner. The basic dilemma posed by the multi-port, multi-frequency combiners is that undesired mode-generating discontinuities must be avoided in the overmoded waveguide sections, and yet some means must be provided for coupling selected signals with one or more ports located in the overmoded section of waveguide. Previous solutions of this dilemma have involved various complex, costly and/or physically cumbersome designs.

In co-pending U.S. patent application Ser. No. 384,997, filed June 4, 1982, for "Multi-Port Combiner for Multi-Frequency Microwave Signals", assigned to the assignee of the present invention, there is described an improved multi-port combiner that can be economically manufactured and yet provides excellent performance characteristics when used with co-polarized signals in two or more frequency bands.

DISCLOSURE OF THE INVENTION

It is a primary object of the present invention to provide an improved multi-port, multi-frequency combiner having a different physical structure, new coupling mechanisms, and significantly improved operating characteristics. More particularly, an objective of this invention is to provide such a combiner which does not require the use of balanced feeds in many applications, thereby reducing the cost of the combiner; which permits relatively wide separation of frequency bands; which provides high power-handling capability; which has excellent isolation among junctions, frequency bands and polarization planes; which is relatively easy to tune, thereby further reducing manufacturing costs; and/or which permits relatively wide mechanical tolerances while still meeting competitive performance specifications.

The present invention realizes the foregoing objectives by providing a multi-port, multi-frequency combiner comprising a main waveguide having a cross section in the shape of a right-angle parallelogram and dimensioned to simultaneously propagate co-polarized signals in different frequency bands and at least one signal that is orthogonally polarized with respect to the co-polarized signals, at least a portion of the waveguide being overmoded; a plurality of junctions spaced along the length of the main waveguide for coupling selected signals in the different frequency bands in and out of the waveguide, at least one of the junctions being located in an overmoded portion of the waveguide, each of the junctions having an unbalanced or pseudo-balanced feed with only a single side-arm waveguide for transmitting and receiving the signals; and filtering means disposed within the main waveguide and operatively associated with each junction therein for signals in the highest frequency band, the filtering means having (1) a stopband characteristic for coupling signals in said highest frequency band between the main waveguide and the junction and the side-arm waveguide connected thereto, and (2) a passband characteristic for passing signals in lower frequency bands past the junction.

In the preferred embodiment of the invention, the waveguide has an overmoded section with a square cross-section and a single-moded section with a rectangular cross-section, with the overmoded and single-moded sections being joined by a transition section having at least one side wall which is tapered to effect the transition from the square cross-section to the rectangular cross-section.

It is to be understood that the term "rectangular" is used herein in a limited sense, meaning a right-angle parallelogram with unequal sides. The generic term "right-angle parallelogram" is used to encompass both squares (equal sides) and rectangles (unequal sides).

BEST MODE FOR CARRYING OUT THE INVENTION

Figure 1:
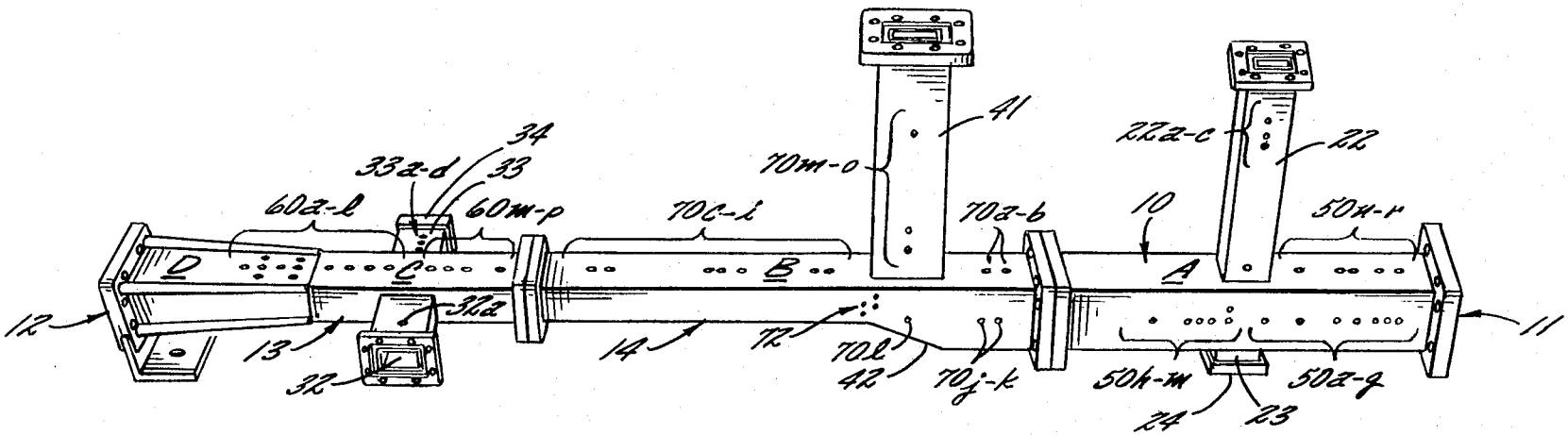
FIG. 1 is a perspective view of a four-port combiner embodying the present invention.
Figure 2:
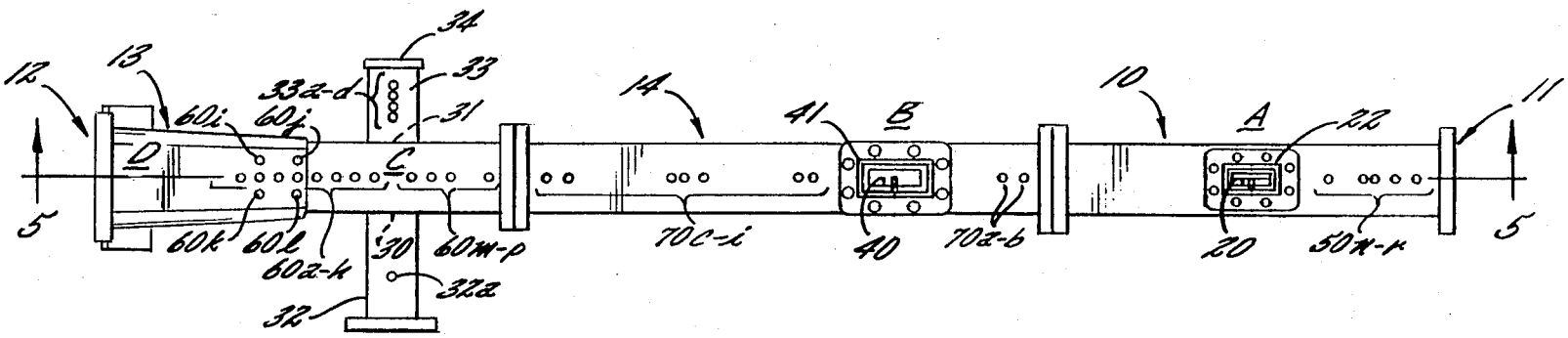
FIG. 2 is a top plan view of the combiner of FIG. 1.
Figure 3:
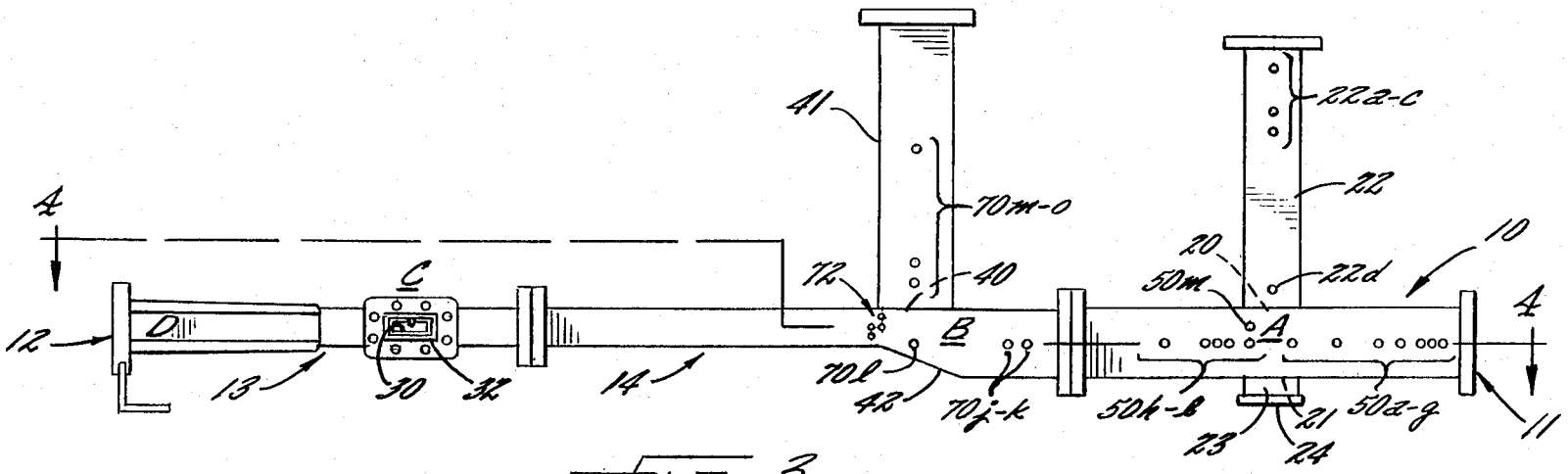
FIG. 3 is a side elevation of the combiner of FIG. 1.

While the invention has been shown and will be described in some detail with reference to specific exemplary embodiments, there is no intention that the invention be limited to these particular embodiments. On the contrary, it is intended to cover all modifications, alternatives and equivalents which may fall within the spirit and scope of the invention as defined by the appended claims.

Turning now to the drawings and referring first to FIGS. 1 through 7, there is shown a four-port combiner whose forward portion includes a square waveguide 10 with an open end or mouth 11 through which signals are propagated to and from four junctions A, B, C and D. The other end 12 of the combiner is also open, serving as the junction D. The four junctions A, B, C and D are spaced along the length of the combiner for transmitting and receiving two pairs of co-polarized signals in two different frequency bands. More specifically, junctions A and B are longitudinally aligned with each other for supporting one pair of co-polar signals, and junctions C and D are similarly aligned for supporting the other pair of co-polar signals. One of the junctions in each aligned pair, namely junction A in one pair and junction C in the other pair, is dimensioned to transmit and receive signals in the higher frequency band, while the other two junctions B and D are dimensioned to transmit and receive signals in the lower frequency band. For example, in a typical application junctions A and C handle orthogonally polarized signals in the 6-GHz frequency band (5.925 to 6.425 GHz), and junctions B and D handle orthogonally polarized signals in the 4-GHz frequency band (3.7 to 4.2 GHz). The microwave signals can be transmitted in one of these frequency bands and received in the other frequency band, or the signals can be simultaneously transmitted and received in both frequency bands using the different polarizations.

The square waveguide 10 is wide enough, along both transverse axes, to permit the propagation therethrough of the two orthogonally polarized, low-frequency signals, as well as the orthogonally polarized high-frequency signals. Thus, the square waveguide 10 is necessarily overmoded. The rear portion of the combiner, on the other hand, handles only one pair of co-polarized signals, and thus is formed from a single-moded rectangular waveguide section 13. Between the rectangular rear section 13 and the square front section 10 is a transition section 14 which tapers from a rectangular cross-section at one end to a square cross-section at the other end.

Figure 4:
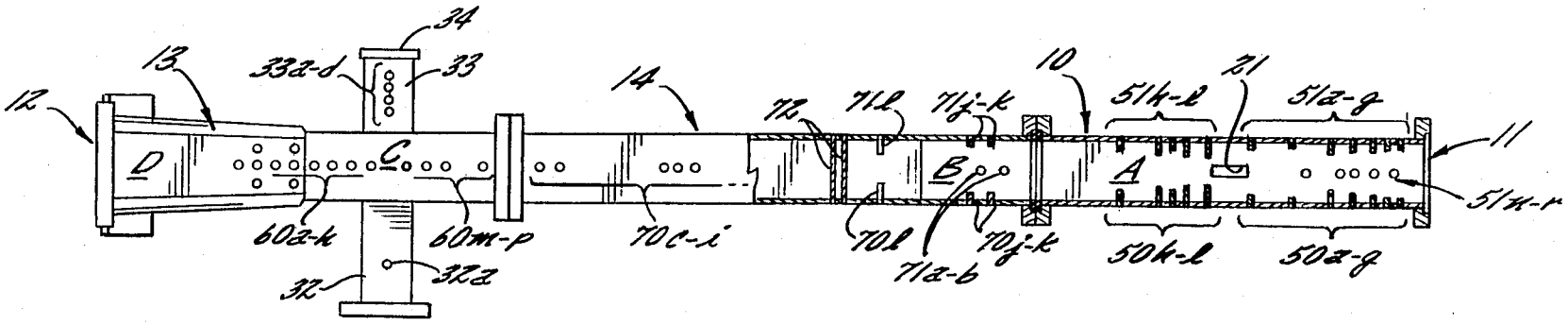
FIG. 4 is a section taken generally along line 4—4 in FIG. 3.
Figure 5:
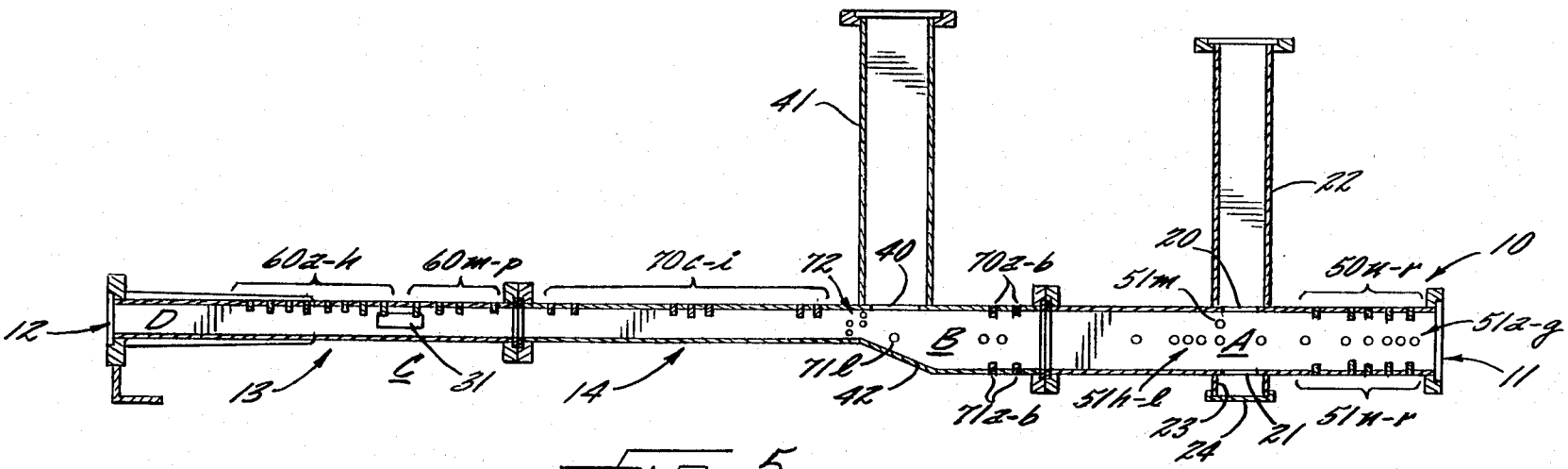
FIG. 5 is a section taken generally along line 5—5 in FIG. 2.
Figure 6:
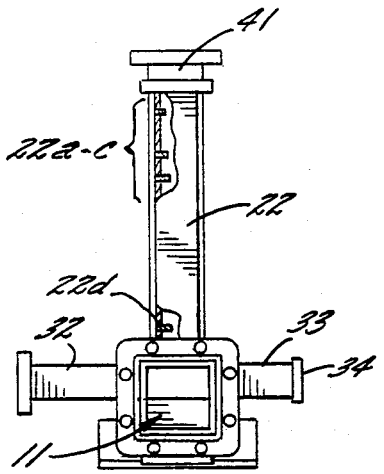
FIG. 6 is an end elevation taken from the right-hand end of the combiner in FIG. 1.
Figure 7:
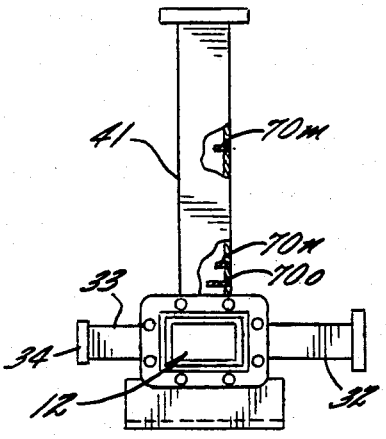
FIG. 7 is an end elevation taken from the left-hand end of the combiner in FIG. 1.

As can be seen most clearly in FIGS. 4 and 5, the slots which are formed in the walls of the waveguide sections 10, 14 and 13 to define the locations of the three junctions A through C have rectangular configurations, and each of these slots is connected to a corresponding side-arm waveguide of rectangular cross-section. Each of the two high-frequency junctions A and C includes a pair of diametrically opposed slots to form a pseudo-balanced coupling between the main waveguide 10 or 13 and the side-arm waveguides at these junctions. The rectangular slots at all three junctions A, B and C are of the H-plane type and have their long dimensions extending in the longitudinal direction, i.e., parallel to the main axis of the combiner.

It has been found that with the main waveguide used in the combiner of this invention, the slots leading to the side-arm waveguides can be made of different sizes. For example, the slots may have a length of about 40 to 100% of the broad dimension of the side-arm waveguide and a width of about 40 to 100% of the narrow dimension of the side-arm waveguide. Although the illustrative combiner utilizes such a wide slot only at junction C, the slots at junctions A and B could be widened to increase the power-handling capability of the combiner, as well as to widen the bandwidth.

Examining the first high-frequency junction A in more detail, the slots at this junction are in the form of two diametrically opposed irises 20 and 21 coupled to a rectangular side-arm waveguide 22 and a stub waveguide 23, respectively. A shorting plate 24 closes the outer end of the stub waveguide 23. The purpose of the stub waveguide 23 and its iris 21 is to produce the desired impedance matching at the high-frequency junction A, providing shunt stub tuning that reduces the return loss while at the same time eliminating excitation of non-symmetrical higher order modes. As can be seen most clearly in FIGS. 1 and 3, a plurality of tuning screws 22*a–d* are provided in one wall of the side arm 22 to facilitate the tuning of junction A.

The structure of the other high-frequency junction, junction C, is similar to that of junction A, except that everything is rotated 90° around the main axis of the combiner, and there are no irises in the slots. Thus, junction C has two diametrically opposed slots 30 and 31 coupled to a rectangular side-arm waveguide 32 and a stub waveguide 33, with a shorting plate 34 closing the outer end of the stub waveguide 33. The stub waveguide 33 is provided with tuning screws 33*a–d*, and the side-arm waveguide 32 is provided with a single tuning screw 32*a*.

Turning next to the low-frequency junction B, this junction has only a single rectangular slot 40 connected to a single rectangular side-arm waveguide 41. The center of this junction is preferably aligned with the center of the tapered side wall 42 of the transition section 14 so that the tapered wall 42 operates as a miter bend that, in conjunction with the pins and tuning screws described below, guides the low-frequency signals between the slot 40 and the combiner mouth 11 leading to the antenna. The tapered side wall 42 also operates as a transformer between both junctions C and D and the antenna.

The second low-frequency junction D is formed by the open end 12 of the single-moded rectangular waveguide section 13. This junction handles the low-frequency signals which are polarized orthogonally with respect to the low-frequency signals handled at junction B.

In order to couple the desired signals into the slots at the respective junctions A, B and C, and to pass the other signals past each slot, filtering means are provided at the two high-frequency junctions A and C. More particularly, the filtering means associated with each of the high frequency junctions A and C have stopband characteristics for coupling the high frequency signals between the main waveguide section 10 or 13 and the high-frequency slots and side arms, and a passband characteristic for passing low-frequency signals past the slots of the high-frequency junctions. In addition, the filtering means and the geometry of the high-frequency junctions suppress spurious excitation of signals in undesired propagation modes different from the mode in which the desired signals are being propagated.

No filters are required in any of the side-arm waveguides, though side-arm filters may be added as optional features if desired. The high-frequency slots and side arms at junctions A and C are dimensioned to support only the high frequency signals; thus, these slots and side arms themselves serve to filter out any low frequency signals. At the low frequency junction B, both the low frequency and high frequency signals to be passed by this junction are orthogonally polarized relative to the slot 40, and thus no filters are required in the side arm 41. At the low frequency junction D, only the desired low-frequency signal is present, and thus there is no need for any filters whatever.

In the particular embodiment illustrated, the filtering network associated with the first 6-GHz junction (junction A) takes the form of two opposed rows of conductive posts, 50*h–l* and 51*h–l* extending into the square waveguide 10 along a plane located midway between and parallel to the two irises 20 and 21, plus a pair of offset posts 50*m*, 51*m*. These posts 50*h–m* and 51*h–m* form a filter which is virtually invisible to the orthogonally polarized signals of junctions C and D. This filter has a stopband characteristic which couples one of the two orthogonally polarized 6-GHz signals into the side arm 22 of junction A, and a passband characteristic which allows the co-polarized 4-GHz signal to pass junction A unimpeded. That is, the locations and lengths of posts 50*h–m* and 51*h–m* are selected to pass the 4-GHz signals for junction B and to reject the co-polarized 6-GHz signals, thereby diverting the latter into the desired side arm 22. Both the 4-GHz and the 6-GHz signals that are orthogonally polarized relative to the 6-GHz signal coupled to junction A pass the junction-A filter unimpeded.

Two additional sets of opposed conductive posts 50*a–g* and 51*ag* on the front side of junction A match both the 4-GHz and the 6-GHz signals for junctions A and B, thereby minimizing the VSWR for those signals.

In addition to the posts 50*a–m*, 51*a–m*, two further rows of opposed posts 50*n–r*, 51*n–r* extend into the square waveguide 10 along a plane that is perpendicular to the plane of the posts 50*a–l* 51*a–l*. That is, the plane of the posts 50*n–r*, 51*n–r* longitudinally bisects the irises 20, 21 of junction A. These posts cooperate with certain of the posts at junction B to match both the 4-GHz and 6-GHz signals for junctions C and D.

The particular filter arrangement illustrated is only one example of a configuration that has been found to produce good results in a four-junction combiner for orthogonally polarized 4 and 6 GHz signals; it will be understood that other configurations will produce similar results for the same or different frequency bands and/or for different waveguide configurations. Similarly, the posts which are in the form of screws for easy adjustment of radial length in the illustrated embodiment, may be replaced by balanced vanes, fins, rods, pins or other tunable devices.

The filtering network associated with the second 6-GHz junction (junction C) is formed by a set of conductive posts 60*a–l* extending into the rectangular waveguide 13. Posts 60*a–h* and 60*m–p* are centered on a plane located midway between the two irises 30 and 31, while posts 60*i–l* are located symmetrically on opposite sides of that plane. The filter formed by this set of posts 60*a–l* is similar to the filter formed by the two sets of posts 50*h–m* and 51*h–m* at junction A, in that both filters have similar stopband and passband characteristics, i.e., the filter formed at junction C by the posts 60*a–l* has a stopband characteristic which couples the 6-GHz signal into the side arm 32 of junction C, and a passband characteristic which allows the co-polarized 4-GHz signal to pass junction C unimpeded.

Turning next to the 4-GHz junction B, two opposed sets of posts 70*a–b* and 71*a–b* and a further single set of posts 70*c–i* associated with this junction, in cooperation with posts 50*n–r*, 51*n–r* at junction A, match the 4 and 6-GHz signals of junctions C and D. Additional posts 70*j–o* and 71*j–l* match the 4-GHz signal for junction B, helping to guide this signal into the junction B side arm 41. This junction also includes a set of transverse pins 72 which cooperate with the tapered side wall 42 to direct the 4-GHz signal from the antenna to the junction B side arm 41.

The electrical characteristics of the components of the present invention are well known. For example, in Starr, *Radio and Radar Technique,* Sir Isaac Pitman & Sons, London, 1953, pp. 126–133, the author describes the electric characteristics of discontinuities in waveguides, and specifically describes the impedance of posts having a certain diameter, depth of waveguide penetration, and length. Further, in Harvey, *Microwave Engineering,* Academic Press, New York, 1963, 214–219, the author discloses the use of posts in the construction of a pass-band filter. In addition, the effect of stub guides for impedance matching is also well known, and is generally described in Terman, *Electronic And Radio Engineering,* McGraw-Hill, New York, 4th Ed. 1965, pp. 149–150.

One specific example of the combiner shown in FIGS. 1–7 was made of brass with a waveguide section 10 of square cross-section, 1.812″×1.812″, joined to an intermediate waveguide section 14 of similar square cross-section at one end and tapered down to a rectangular cross-section, 1.812″×0.872″, at the other end. The third waveguide section 13 had a rectangular cross-section along its full length, tapering from 1.812″×0.872″ to 2.290″×1.145″. The 6-GHz junction A had 0.94″×0.30″ rectangular iris, while the 6-GHz junction C had a WR137 rectangular waveguide side arm, stub and slots. The stub at junction A was 0.813″ in length, and the junction-C stub was 2.34″ long. The 4-GHz junction in the intermediate section 14 had a 1.7″×0.3″ rectangular iris, and the 4-GHz side arm was WR181 rectangular waveguide. The locations and lengths of the posts and pins associated with the various junctions were as shown in FIGS. 1–5 described above.

In tests using orthogonally polarized signals (each signal being linearly polarized) in each of two frequency bands extending from 3.690 to 4.210 GHz and from 5.915 to 6.435 GHz, this combiner produced the following results:

| | |
|---|---|
| Return Loss, Junctions D, C: | 30 dB |
| Return Loss, Junctions B, A: | 33 dB |
| Polarization Isolation, 4 GHz: | 39 dB |
| Polarization Isolation, 6 GHz: | 43 dB |
| Isolation Between Ports A & B: | 60 dB |
| Isolation Between Ports A & D: | 92 dB |
| Isolation Between Ports C & B: | 46 dB |
| Isolation Between Ports C & D: | 60 dB |

Figure 8:
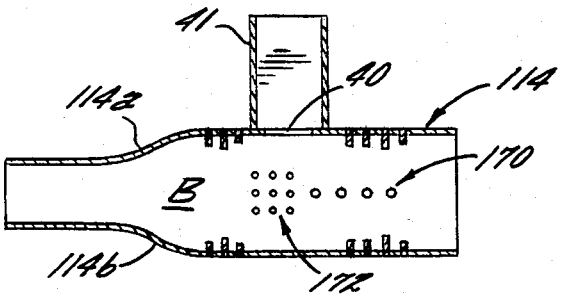
FIG. 8 is a longitudinal section taken through the center section of the main waveguide of a modified combiner embodying the invention.

In the tests described above, the $TM_{11}$ and $TE_{11}$ higher order modes were excited and observed as mode pips in the discrimination curve in the 6-GHz band. To eliminate or at least reduce the generation of such higher order modes, the transition between the square and rectangular sections of the main waveguide can be effected by symmetrically tapering a pair of opposed side walls, rather than tapering only a single side wall. One example of such a transition is illustrated in FIG. 8. In this embodiment, the transition waveguide section 114 has a pair of opposed side walls 114*a* and 114*b* which are tapered symmetrically relative to the central axis of the combiner. The tapered side walls 114*a*, 114*b* do not serve as a miter bend for the coupling of signals to and from the side arm 41, and thus additional pins 172 and posts 170 are added to perform this function. It will be noted that the tapered side walls 114*a*, 114*b* are not only symmetrical, but also are tapered in a non-linear configuration to reduce VSWR and avoid excitation of the $TM_{11}$ and $TE_{11}$ modes; this non-linear taper is useful with either the dual tapered side walls of FIG. 8 or the single tapered side wall of FIGS. 1–7. Another example of a suitable non-linear configuration is a stepped side wall.

While the invention has been described above with particular reference to an exemplary four-port combiner, it will be appreciated that the invention is applicable to a large number of different combiner configurations having two or more longitudinally spaced junctions for handling signals in two or more different frequency bands. The signals in one or all of the different frequency bands may be orthogonally polarized, and the cross-section of the main waveguide can be square along the entire length thereof if desired.

As can be seen from the foregoing detailed description, this invention provides an improved multi-port, multi-frequency combiner which does not require the use of balanced feeds in many applications, thereby reducing the cost of the combiner. The main waveguide of the combiner has a right-angle parallelogram cross-section along its entire length, and thus the longitudinal slots at the junctions do not generate any higher order modes in many dual-band applications (e.g., 4 and 6 GHz). The square and/or rectangular cross-sections of the main waveguide also provide extremely good polarization-holding properties as well as good isolation among the various junctions in different frequency bands. The improved combiner is also relatively easy to tune, particularly in the absence of any balanced feeds, thereby reducing the manufacturing cost. The power handling capability of the combiner can also be significantly increased by increasing the width of the irises opening into the various side arms. The particular embodiment illustrated in FIG. 8, with the symmetrically tapered side walls in the transition between the square and rectangular waveguide sections, is particularly advantageous in avoiding the excitation of the $TE_{11}$ and $TM_{11}$ modes and in improving VSWR.

I claim as my invention:

1. A combiner for transmitting and receiving co-polarized microwave signals in a selected propagation mode in at least two different frequency bands, said combiner comprising a main waveguide having a cross-section in the shape of a right-angle parallelogram and dimensioned to simultaneously propogate co-polarized signals in said different frequency bands and at least one signal that is orthogonally polarized with respect to said co-polarized signals, at least a portion of said main waveguide being overmoded, a plurality of junctions spaced along the length of said waveguide for coupling selected signals in said different frequency bands in and out of said waveguide, at least one of said junctions being located in an overmoded portion of said main waveguide, at least one of said junctions having a pseudo-balanced feed with only a single side-arm waveguide for transmitting and receiving said signals, said pseudo-balanced feed comprising a pair of diametrically opposed slots in said main waveguide, one of said slots in each pair leading to said side-arm waveguide and the other slot leading to a closed waveguide stub for impedance matching, and filtering means disposed within said main waveguide and operatively associated with each junction therein for signals in the highest frequency band, said filtering means having (1) a stopband characteristic for coupling signals in said highest frequency band between said main waveguide and said junction and said side-arm waveguide connected thereto, and (2) a passband characteristic for passing signals in lower frequency bands past said junction.

2. A combiner as set forth in claim 1 wherein said main waveguide has an overmoded section with a square cross-section.

3. A combiner as set forth in claim 1 wherein said main waveguide has an overmoded section with a square cross-section and a single-moded section with a rectangular cross-section, said overmoded and single-moded sections being joined by a transition section having at least one side wall which is tapered to effect the transition from said square cross-section to said rectangular cross-section.

4. A combiner as set forth in claim 3 wherein at least one pair of opposed side walls of said transition section are tapered to effect said transition.

5. A combiner as set forth in claim 4 wherein all the tapered side walls are tapered symmetrically with respect to the axis of said waveguide.

6. A combiner as set forth in claim 3 wherein said taper is non-linear.

7. A combiner as set forth in claim 3 wherein said junctions include first and second junctions located in said overmoded section of said waveguide in longitudinal alignment with each other for transmitting and receiving a first pair of co-polarized signals in different frequency bands, and third and fourth junctions located in said single-moded section of said waveguide in longitudinal alignment with each other for transmitting and receiving a second pair of co-polarized signals in different frequency bands.

8. A combiner as set forth in claim 7 wherein said first and second pairs of co-polarized signals are orthogonally polarized relative to each other.

9. A combiner as set forth in claim 3 wherein one of said junctions is located at the same longitudinal position as said tapered side wall.

10. A combiner as set forth in claim 1 wherein each of said junctions includes a rectanglar slot whose width is at least 40% of the narrow dimension of the corresponding side-arm waveguide.

11. A combiner as set forth in claim 1 wherein said side-arm waveguides are rectangular waveguides.

12. A combiner as set forth in claim 1 wherein the junction for the higher frequency signals in each set of co-polarized signals is located closer to the mouth of the combiner than the junctions for lower frequency signals in that set.

13. A combiner for transmitting and receiving co-polarized microwave signals in a selected propagation mode in at least two different frequency bands, said combiner comprising a main waveguide having a cross-section in the shape of a right-angle parallelogram and dimensioned to simultaneously propagate co-polarized signals in said different frequency bands, said waveguide having an overmoded section with a square cross-section and a single-moded section with a rectangular cross-section, said overmoded and single-moded sections being joined by a transition section having at least one side wall which is tapered to effect the transition from said square cross-section to said rectangular cross-section, a plurality of junctions spaced along the length of said waveguide for coupling selected signals in said different frequency bands in and out of said waveguide, at least one of said junctions being located in each of the overmoded and single-moded sections of the waveguide, said junctions for transmitting and receiving the highest frequency signals each comprising a pair of diametrically opposed slots in said main waveguide, one of the slots in each pair leading to a side-arm waveguide and the other slot leading to a closed waveguide stub for impedance matching, and a filtering means disposed within said main waveguide and operatively associated with each junction therein for signals in the highest frequency band, said filtering means having (1) a stopband characteristic for coupling signals in said highest frequency band between said main waveguide and said junction and said side-arm waveguide connected thereto, and (2) a passband characteristic for passing signals in lower frequency bands past said junction.

14. A combiner as set forth in claim 13 wherein at least one pair of opposed side walls of said transition section are tapered to effect said transition.

15. A combiner as set forth in claim 14 wherein all the tapered side walls are tapered symmetrically with respect to the axis of said waveguide.

16. A combiner as set forth in claim 13 wherein said taper is non-linear.

17. A combiner as set forth in claim 13 wherein said junctions include first and second junctions located in said overmoded section of said waveguide in longitudinal alignment with each other for transmitting and receiving a first pair of co-polarized signals in different frequency bands, and third and fourth junctions located in said single-moded section of said waveguide in longitudinal alignment with each other for transmitting and receiving a second pair of co-polarized signals in different frequency bands.

18. A combiner as set forth in claim 17 wherein said first and second pairs of co-polarized signals are orthogonally polarized relative to each other.

19. A combiner as set forth in claim 13 wherein one of said junctions is located at the same longitudinal position as said tapered side wall.

20. A combiner as set forth in claim 13 wherein each of said junctions includes a rectangular slot whose width is at least 40% of the narrow dimension of the corresponding side-arm waveguide.

21. A combiner as set forth in claim 13 wherein each of said junctions includes a rectangular side-arm waveguide.

22. A combiner as set forth in claim 13 wherein the junction for the higher frequency signals in each set of co-polarized signals is located closer to the mouth of the combiner than the junctions for lower frequency signals in that set.

* * * * *